United States Patent [19]

Buchter et al.

[11] Patent Number: 5,013,265

[45] **Date of Patent: * May 7, 1991**

[54] CONNECTOR FOR MATING BLADE-SHAPED MEMBERS

[75] Inventors: Randolph L. Buchter; John P. Huss, Jr., both of Harrisburg, Pa.

[73] Assignee: AMP Incorporated, Harrisburg, Pa.

[ * ] Notice: The portion of the term of this patent subsequent to Jan. 1, 2008 has been disclaimed.

[21] Appl. No.: 515,980

[22] Filed: Apr. 27, 1990

[51] Int. Cl.[5] ..... H01R 13/11

[52] U.S. Cl. ..... 439/724; 439/787; 439/744

[58] Field of Search ..... 439/786, 787, 723, 724, 439/687, 676, 654, 744

[56] References Cited

U.S. PATENT DOCUMENTS

| | | | |
|---|---|---|---|
| 3,149,893 | 9/1964 | Dupre | 339/14 |
| 3,778,753 | 12/1973 | Occhipinti et al. | 339/156 R |
| 4,220,382 | 9/1980 | Ritchie et al. | 339/17 LM |
| 4,474,417 | 10/1984 | Millhimes | 439/744 |
| 4,659,155 | 4/1987 | Walkup et al. | 339/14 R |
| 4,684,191 | 8/1987 | Feher et al. | 439/246 |
| 4,747,790 | 5/1988 | Masuda et al. | 439/631 |
| 4,845,589 | 7/1989 | Weidler et al. | 361/342 |
| 4,878,862 | 11/1989 | Wise | 439/787 |
| 4,981,449 | 1/1991 | Buchter | 439/724 |

*Primary Examiner*—Gary F. Paumen
*Assistant Examiner*—Kevin J. Carroll
*Attorney, Agent, or Firm*—Katherine A. Nelson

[57] ABSTRACT

An electrical connector 10 for mating blade-shaped members 114,130 includes a pair of subassemblies 12, each subassembly 12 comprising a housing member 14 and at least one first terminal element 50 secured to the inner surface of respective housing members 14, and means for securing subassemblies 12 together. Each first terminal element 50 includes body portion 52 and first and second arrays of contact arms 66,72 extending outwardly from opposite ends 62,64 thereof. In the assembled connector 10, the free ends 68,74 of contact arms 66,72 of respective terminal elements 50 extend inwardly toward each other defining first and second receptacles 110,112 for receiving first and second blade-shaped members respectively. Upon mating connector 10 with first and second blade-shaped members 114,130, the respective contact arms 66,72 are deflected outwardly by the blade-shaped members 114,130 and engage the blade-shaped members 114,130 at a plurality of locations respectively on first and second sides 116,132;122,138 thereof, thereby establishing a plurality of current paths corresponding first and second sides of the blade-shaped members 114,130.

9 Claims, 7 Drawing Sheets

104
94
88
80
82
102
84
92
86
90
98
96
78
12
74
64
52
72
58
50
54
62
66
56
60
68
34
32
43
38
37
24
18
22
42
36
14
20
22
26
41
30

CONNECTOR FOR MATING BLADE-SHAPED MEMBERS

FIELD OF THE INVENTION

This invention is related to the field of electrical connectors and more particularly to an electrical connector for interconnecting to blade-shaped members.

BACKGROUND OF THE INVENTION

In forming a power distribution system it is necessary to provide means for a hot line carrying power to the required load and a return line to the power source. A plurality of interconnections are typically required on a power distribution system for an integrated circuit logic system. There are connections between the power supply and bus bar, bus bar and a mother board, mother board and the daughter board, and connections between the daughter board and the socket in which chips are usually mounted and a connection between the socket and an actual integrated circuit. For each point of interconnection in the line going from the hot terminal to the load there is another point of interconnection to complete the return line of the circuit. Furthermore, in many integrated circuit systems there can be no more than 250 millivolts of drop in the voltage at each load. In addition, some logic systems require multiple voltage power distribution systems. These systems, therefore, require electrical connectors or contacts that will minimize voltage drops as the load is placed on the system.

To help increase the operating speed, power distribution systems are often designed to use a laminated busbar wherein the hot and return conductors are placed in close proximity separated by a thin insulative layer. One problem associated with laminated bus bars, however, is the inability to use standard two sided receptacle contacts to interconnect the laminated bus bar with another or to terminate to the laminated bus bar since a standard contact will electrically short the outer most conductive layers of the bus bar. Typically interconnections to laminated bus bars are made by providing the bus bar layers with tabs that extend outwardly from the various layers to which a wire or contact may be bolted to one voltage or layer. Since the wide bus bars are good conductors of heat as well as electricity, it is extremely difficult to achieve effective connections to the bus bar by soldering techniques. It is desirable to have a separate means for connecting to the laminated bus bar system that retains the "pluggability" of the system.

SUMMARY OF THE INVENTION

Accordingly, to alleviate the disadvantages and deficiencies of the prior art, the present invention is directed to an electrical connector for mating to blade-shaped members and providing a plurality of electrical contact paths for electrical engagement between corresponding opposed surfaces of two blade-shaped members. More particularly the present invention is directed to a connector that can carry currents of two different voltages across an interface. The connector is comprised of a pair of opposing first and second subassemblies, each subassembly including a housing member, at least a first terminal element secured to an inner surface of the housing member and means for securing the subassemblies together thereby defining respective cavity means at opposite ends thereof for receiving the first and second blade-shaped members. Each terminal element includes a body portion having first and second arrays of cantilevered arms extending to contact areas on the ends thereof. The contact arms of each array extend inwardly into the respective cavity means when the subassemblies are secured together and defined opposed arrays of contact arms in each cavity that are adapted to receive the blade-shaped members upon mating therewith. The contact arms are deflected outwardly by the blade-shaped members toward the respective inner housing surfaces. Upon mating the connector with first and second blade-shaped members, the first terminal arrays receive the first blade-shaped member and the second arrays receive the second blade-shaped member at a plurality of locations therealong. The terminal element of the first subassembly interconnects corresponding first sides of the blade-shaped members and the terminal element of the second subassembly contact corresponding second sides of the blade-shaped members thus allowing the blade-shaped members to be bipolar with the first and second sides thereof being electrically isolated from each other.

In the preferred embodiment each subassembly contains first and second terminal elements that are preferably electrically isolated from each other and are secured to the inner surface of the respective housing member. In one preferred embodiment the inner surface of the housing includes a plurality of flexible latch members which secure terminal elements in position. Preferably the housing members are hermaphroditic. In an alternative embodiment the latch members are formed along the sides of the subassembly housing and secure the elements against the inner surface of the housing. It is an object of the present invention to provide a separable connection between two blade-shaped members such as bus bar, circuit panel or the like thereby maintaining the pluggability of members into the connector.

It is a further object of the invention to provide a separable connection between blade-shaped members having isolated first and second opposed sides.

It is an additional object of the invention to provide a means whereby a plurality of paths may be established whereby the resistance and normal force required for effective interconnection cross an interface can be lower.

It is also an object of the invention to provide a connector having a minimum number of parts and ease of assembly.

It is an additional object of the invention to provide a connector that may readily be adapted to accommodate varying current requirements.

The invention itself, together with further objects and its intended advantages will be best understood by reference to the following detailed description taken in conjunction with the accompanying drawing.

DETAILED DESCRIPTION OF THE PREFERRED EMBODIMENT

Figure 1:
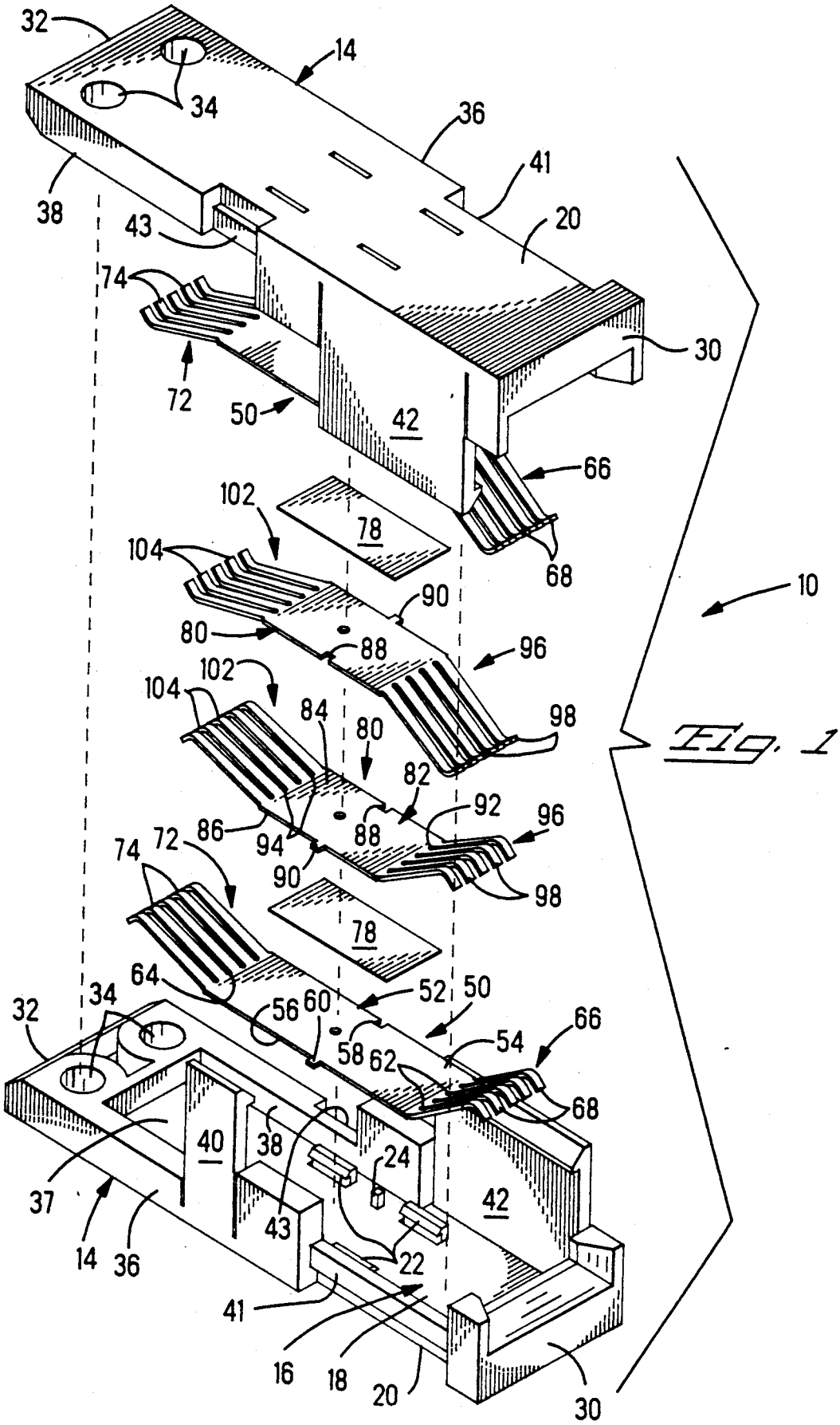
FIG. 1 is an exploded view of a connector made in accordance with the invention.
Figures 2, 3:
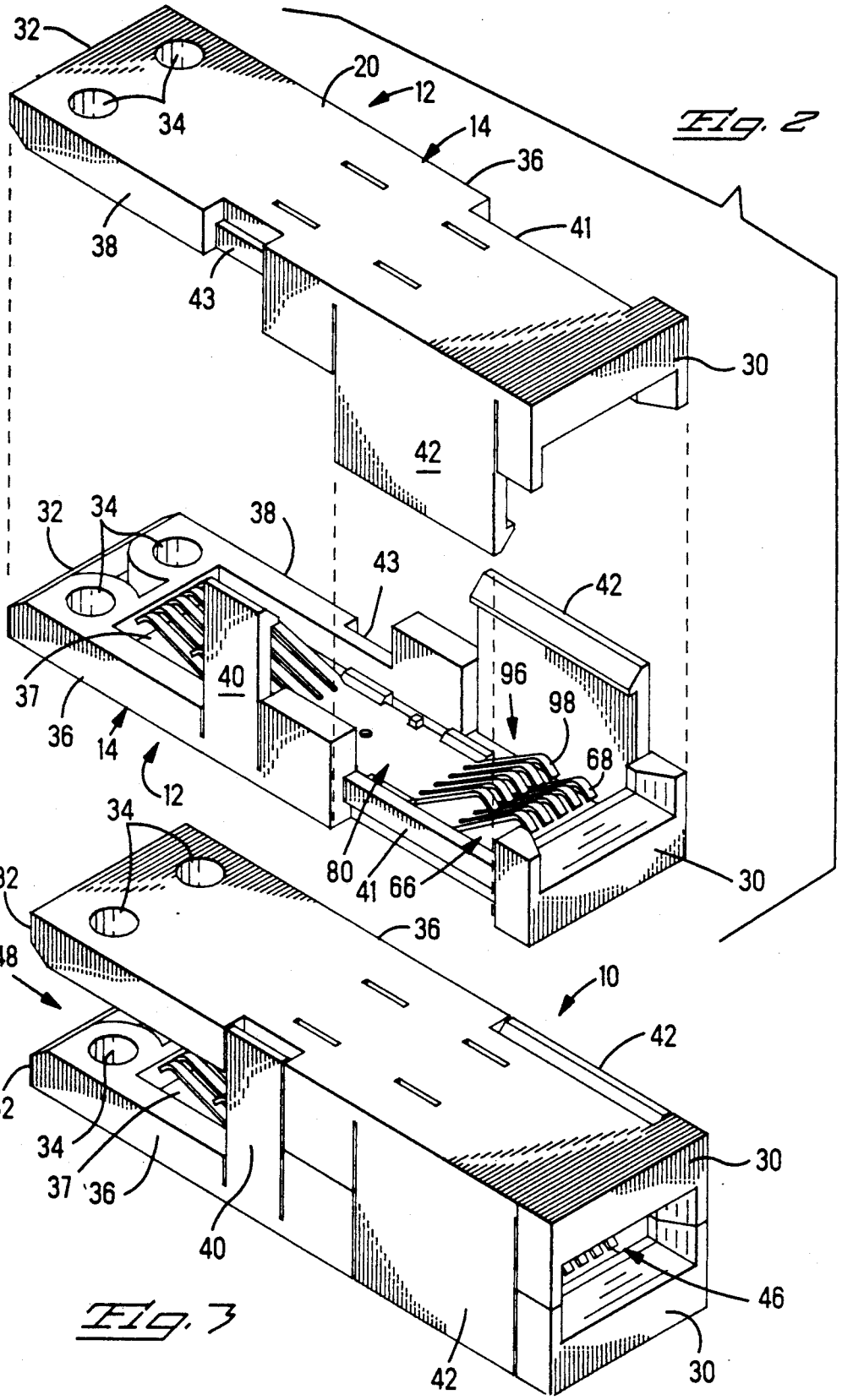
FIG. 2 is an exploded view of the partially assembled connector of FIG. 1.
FIG. 3 is a perspective view of the assembled connector of FIG. 1.
Figure 4:
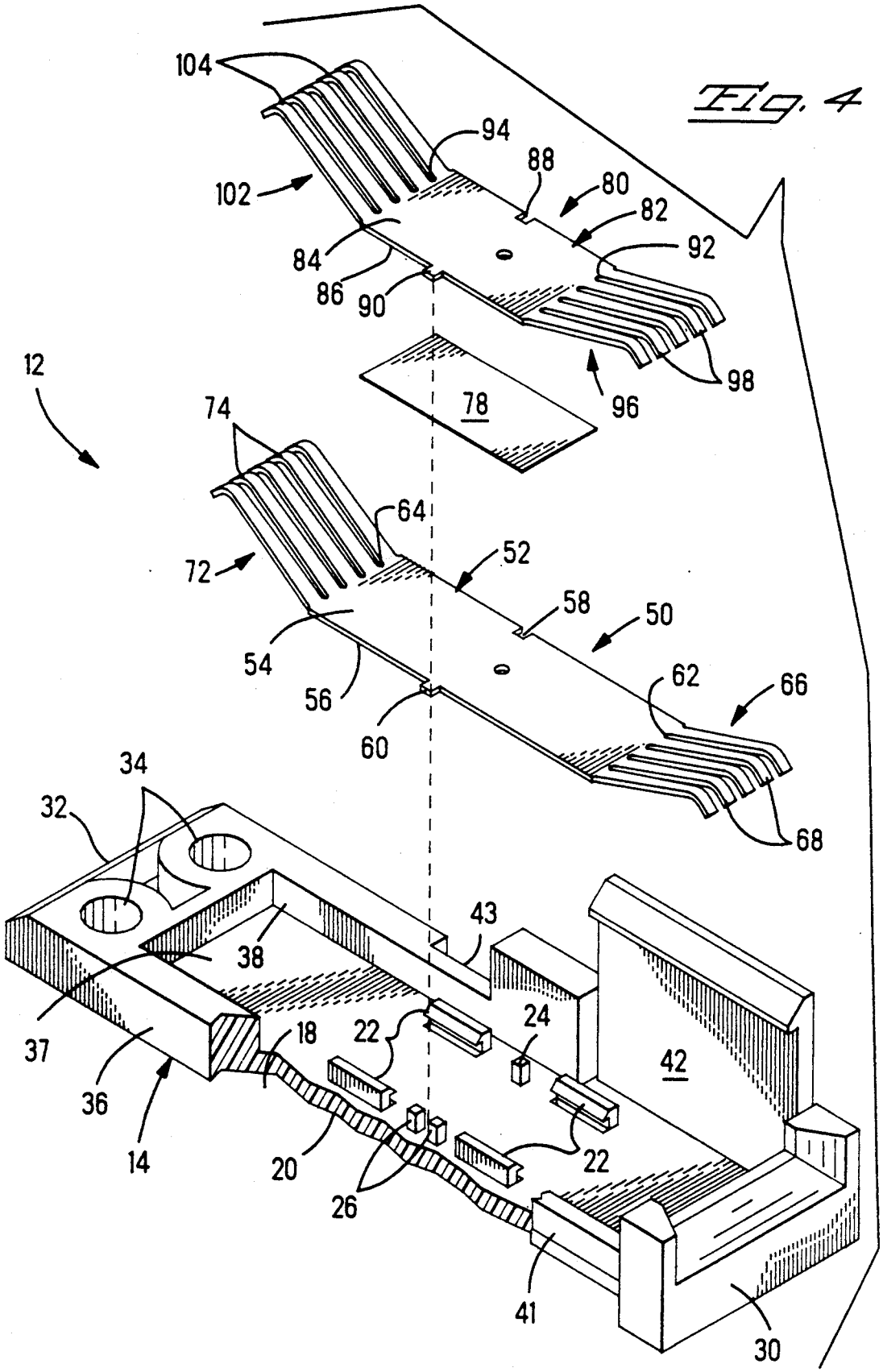
FIG. 4 is an exploded view of a subassembly of the connector of FIG. 1 with part of the housing broken away and illustrating the means for securing the terminal elements in the housing member.
Figure 7:
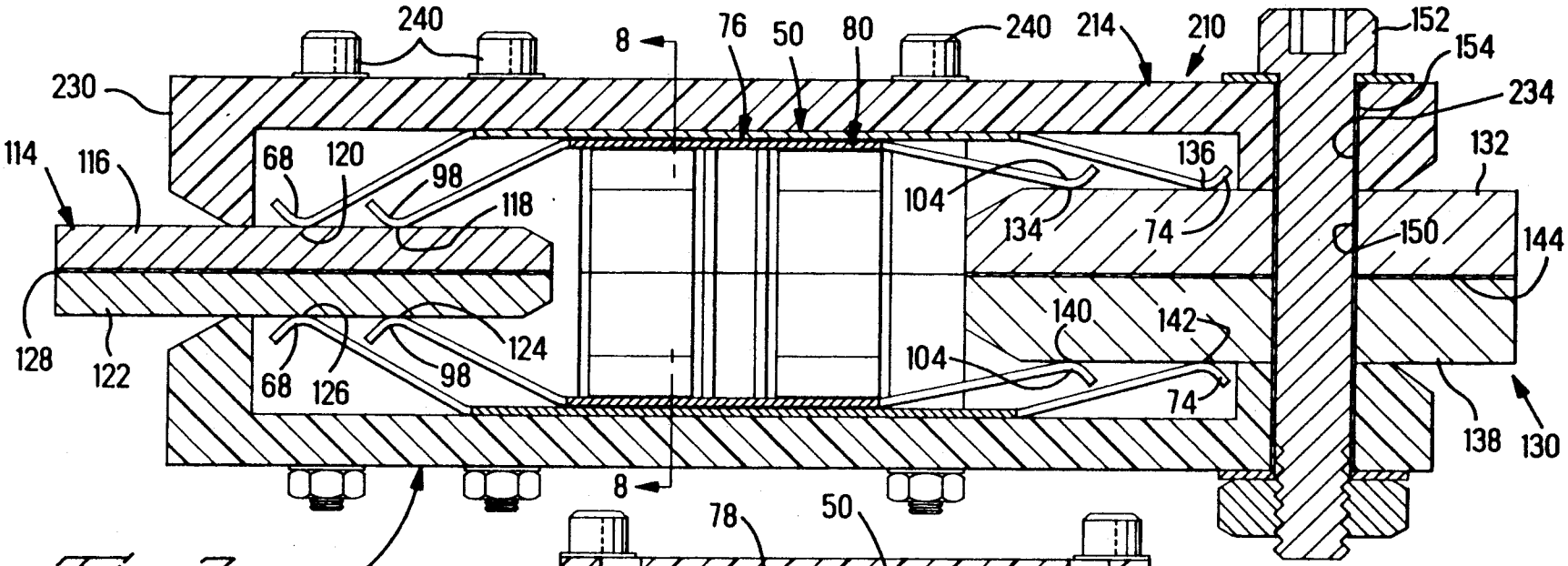
FIG. 7 is a longitudinal section view of the connector of FIG. 6 mated with two blade-shaped members.

Referring now to FIGS. 1 through 4, electrical connector 10 of the present invention is comprised of two subassemblies 12. As best seen in FIG. 4 each subassembly 12 includes a housing member 14, and first and second terminal elements 50,80. Housing member 14 includes a base 16 having inner and outer surfaces 18,20 respectively. A plurality of latches 22 extend upwardly from inner surface 18 of base 16. Latches 22 cooperating with first and second terminal elements 50,80 to secure terminals within the housing I4 as shown in FIG. 2. Locating posts 24,26 are located between the latches 22 and extend upwardly from base 14 along opposite sides of inner surface 18. As seen in FIG. 4, a single post 24 is adjacent sidewall 38 and a pair of spaced posts 26 is adjacent sidewall 36. The locating posts 24,26 cooperate with complementary means 58,60 on the first and second terminal elements to locate or position the terminal elements within the housing 14. The latches 22 and locating posts 24,26 are best seen in FIG. 4. Housing member 14 further includes leading and trailing edges 30,32 and opposed side walls 36,38 defining terminal receiving cavity 37 therebetween. Apertures 34 adjacent trailing edge 32 receive mounting means (not shown) to attach connector assembly 10 to a blade-shaped electrical article in the same manner as shown in FIG. 7. Referring again to FIGS. 1–4, side walls 36,38 further include latching means 40,42 respectively which cooperate with the corresponding housing of a second subassembly 12 to secure connector 10 together. As best seen in FIG. 3, connector 10, when assembled, includes blade receiving aperture 46 at the leading edges 30 and blade receiving aperture 48 at trailing edge 32.

Figure 5:
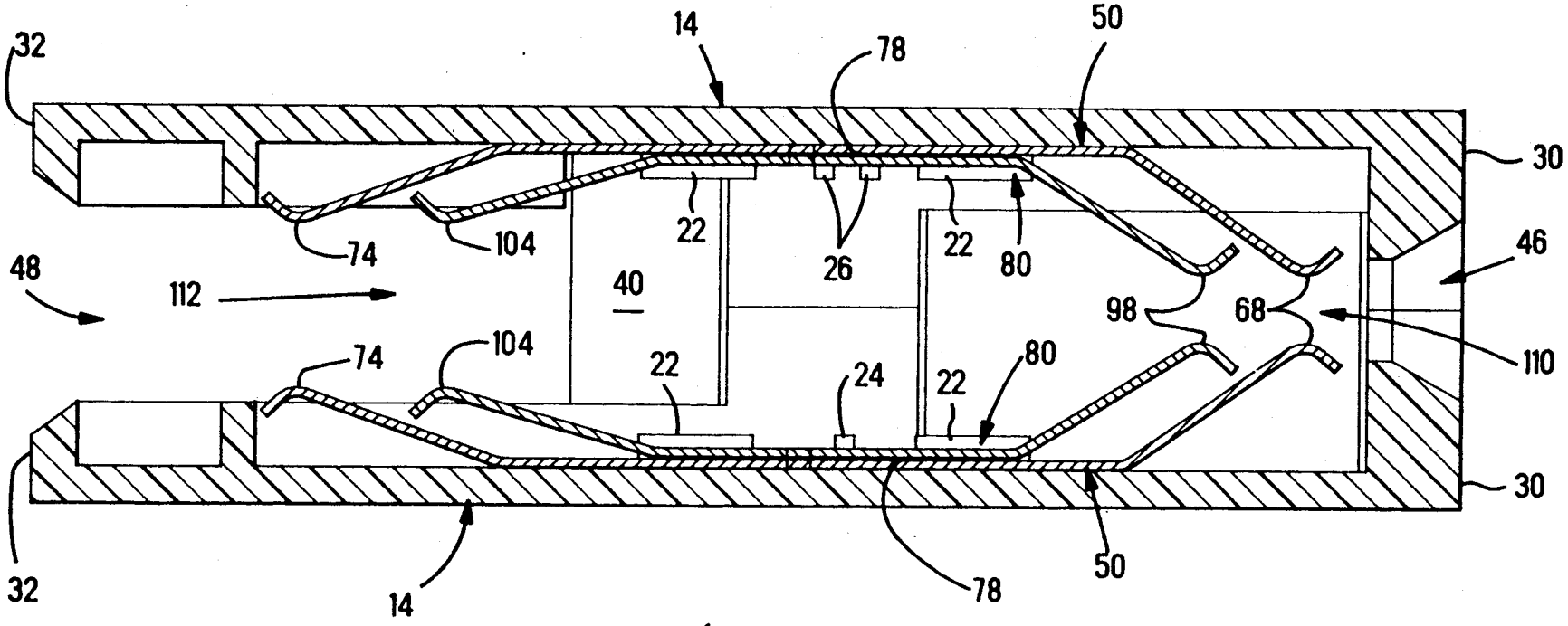
FIG. 5 is a longitudinal section view of the assembled connector of FIG. 1.

As best seen in FIGS. 1 and 4, each first terminal element 50 includes a body section 52 having opposed major inner and outer surfaces 54,56 respectively and leading and trailing edges 62,64. Body section 52 further includes a notch 58 extending inwardly along one side and a corresponding outwardly extending protrusion 60. Body section 52 further includes first and second arrays 66,72 of cantilevered spring contact arms extending outwardly from respective leading and trailing edges 62,64 thereof. In the assembled subassembly 12, as shown in FIG. 5, the major outer surface 56 of first terminal element 50 is adjacent the inner surface 18 of housing base 14 with housing post 24 extending into notch 58 and terminal protrusion 60 extending between the pair of posts 26 on base 16. The contact arms of arrays 66 and 72 extend to respective free ends 68,74 outwardly from the plane of the body section 52 and in line with the respective blade receiving apertures 46,48.

Referring again to FIGS. 1 and 4, each second terminal element 80 includes a body section 82 having opposed major inner and outer surfaces 84,86 having leading and trailing edges 92,94 with notch 88 extending inwardly and protrusion 90 extending outwardly along the opposed side edges thereof. Body section 82 further includes third and fourth arrays 96,102 of spring contact arm extending outwardly from respective leading and trailing edges 92,94 thereof. In assembling the subassembly 12, the second terminal element 80 is disposed inwardly of the first element 50 and preferably insulated therefrom by insulating means 78. The outer major surface 86 of second terminal element 80 is placed against inner major surface 54 of terminal element 50 with notch 88 receiving locating post 24 and protrusion 90 being received between locating posts 26.

The contact arms of third and fourth arrays 96,102 extend to respective free ends 98,104 outwardly from the plane of the respective body section 82. In the assembled subassembly 12, the third arrays 96 are proximate and associated with first arrays 66 and the fourth arrays 102 are proximate and associated with the second arrays 72. The spring contact arms of the first and second arrays 66,72 are longer than the corresponding spring contact arms of the third and fourth arrays 96,102, as best seen in FIGS. 2 and 5. In the assembled connector the free ends 68 of the first array are disposed substantially coplanar with the free ends 98 of the associated third arrays 96 and are located axially outwardly therefrom to extend a first blade receiving receptacle 110. Similarly, the free ends 74 of the second array 72 are disposed substantially coplanar with the free ends 104 of the fourth arrays 102 and are located axially outwardly therefrom thereby extending a second blade receiving receptacle 112, as best seen in FIG. 5.

In assembling connector 10, the subassemblies 12 are placed in opposing relationship such that latches 40 and 42 engage corresponding latch engaging means 41,43 on the opposite housing member. In the preferred embodiment the housings 14 are hermaphroditic members. As is shown in FIG. 5, the corresponding sets of first and second terminal elements 50,80 on the two subassemblies are spaced from each other and the blade receiving receptacles 110,112 are formed adjacent the corresponding openings 46,48 of the housing members 14,14.

Figure 6:
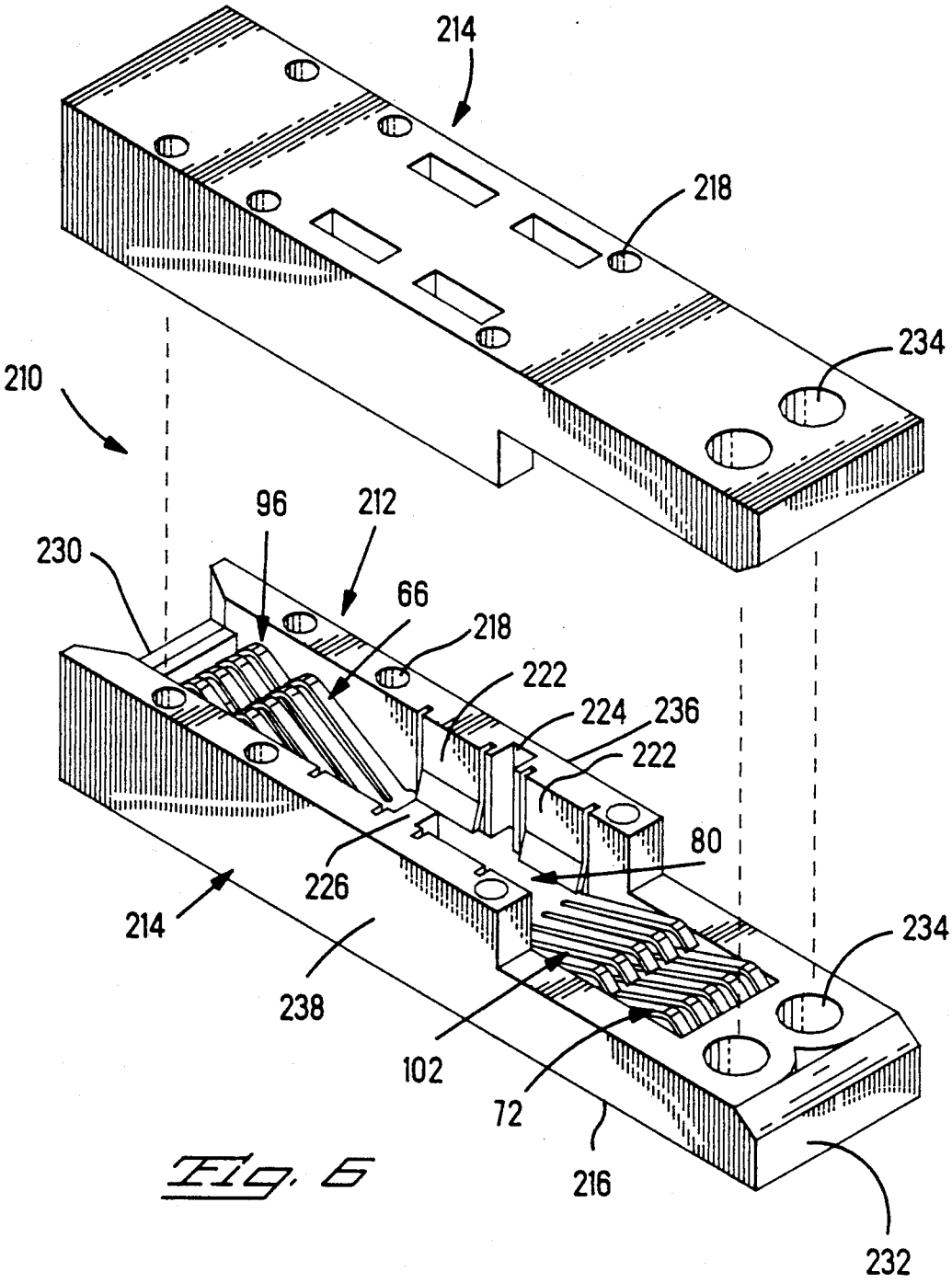
FIG. 6 is a partially exploded view of an alternative embodiment of the connector.
Figure 8:
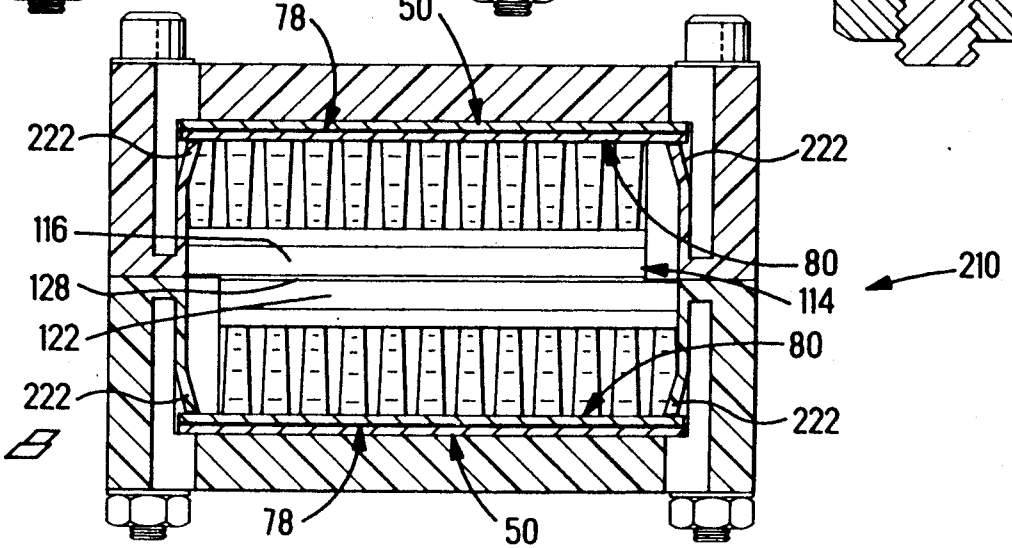
FIG. 8 is a cross sectional view taken along line 8—8 of FIG. 7.

FIGS. 6, 7 and 8 show an alternative connector embodiment 210 comprising two subassemblies 212, each subassembly 212 including a housing member 214 in which are disposed first and second terminal elements 50,80. The first and second terminal elements 50,80 shown in conjunction with the housing member 214 are substantially identical to those shown with connector embodiment 10. Corresponding parts therefore will have the same numbers. In embodiment 210, housing 214 comprises a base 216 having leading and trailing edges 230,232 and opposed sides 236,238. Side walls 236,238 include latching members 222 extending down from top of side walls 236,238 for securing the terminal elements 50,80 in housing 214. As best seen in FIG. 8, latches 222 engage the sides of terminal members 50,80 to secure the terminals in position against the inner surfaces of the housing. Housing 214 further includes a plurality of securing means 240 as shown in FIGS. 7 and 8 for securing the subassemblies 212 together.

FIG. 7 shows the connector embodiment 210 in electrical engagement with first and second blade-shaped members 114,130 respectively. First blade-shaped member 114 is shown as a laminated bar member having a first side 116 and a second side !22 that are insulated from each other by insulating means 128. The second blade-shaped member 130 is shown as a laminated bar member having first side 132 and second side 138 that are insulated from each other by insulating means 144. A dual laminated bus bar member typically is used in power distribution systems to place the hot and return lines in close proximity for a more efficient system. In the embodiment shown, connector assembly 210 is mounted to blade-shaped member 130 by fastening means 152. As shown in FIG. 7, the blade-shaped member 130 includes aperture 150 extending therethrough for receiving fastening means therein. To maintain electrical isolation between the two sets of the electrical terminals 50,80 of two subassemblies 12, an insulating sleeve 154 is disposed around member 152. Upon mating the connector 210 with the blade-shaped members 114 and 130 and outward deflection against the spring bias of all the contact arms by the blade-shaped members 114,130, the free ends 68,98 of the first and third arrays engage the first blade-shaped member 114 at a plurality of outer 120 and inner 118 locations on a first side 116 and at outer and inner locations 126,124 of the second side 122 respectively thereof. Similarly the free ends 74,104 of the second and fourth arrays respectively engage the second blade-shaped member 130 at a plurality of outer 136 and inner 134 locations on a first side 132 and a plurality of outer and inner locations 142,140 along second side 138 thereof, as is best seen in FIG. 7.

Figure 9:
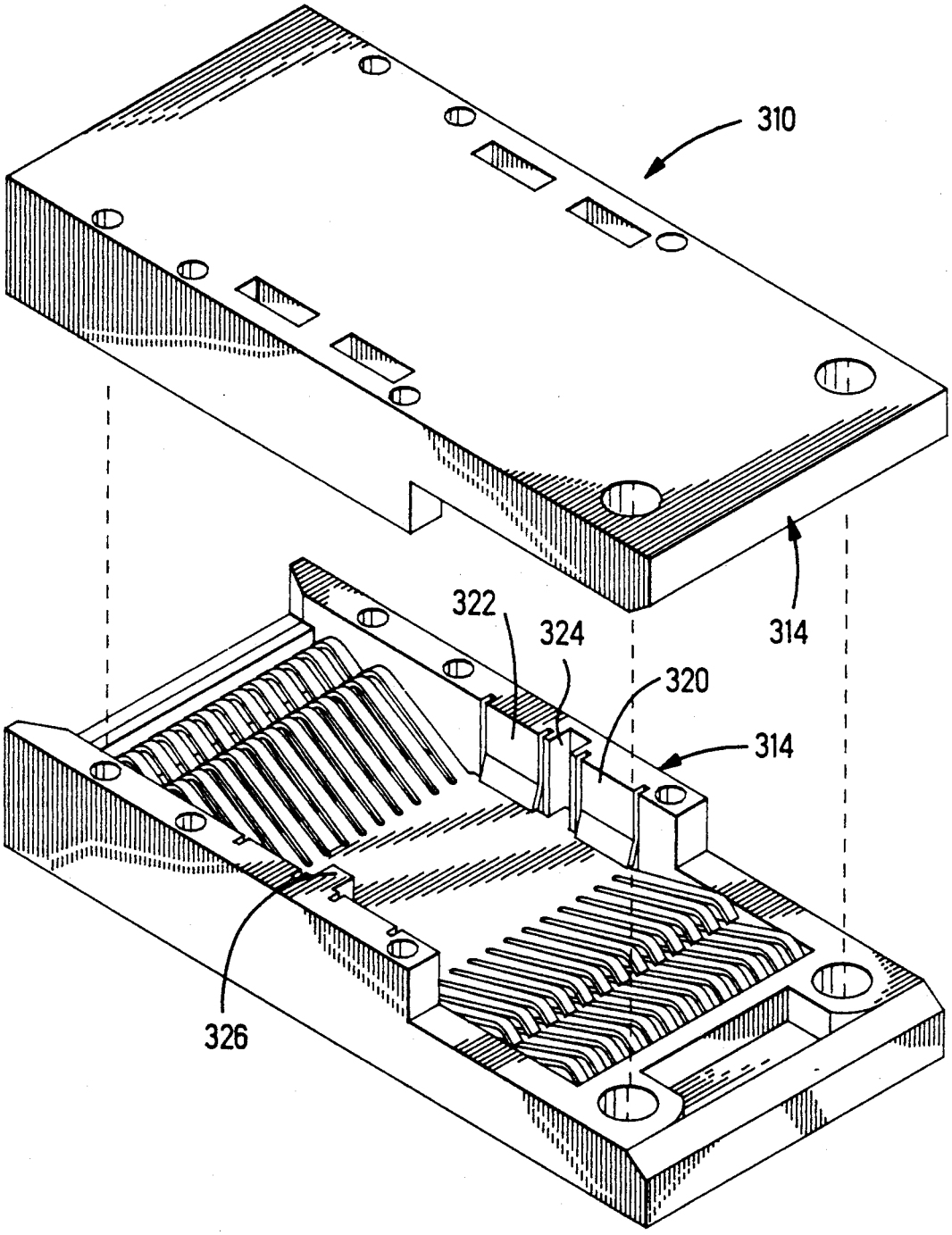
FIG. 9 is a partially exploded view of another embodiment of the connector of FIG. 6.

FIG. 9 shows another connector embodiment 310 having housing member 314, which is similar to that of embodiment 210 but is wider to accommodate wider terminal elements. A similar slot 324, protrusions 326 and latches 322 locate and secure terminal elements in the housing. The wider terminal elements are used when the connector has to carry greater current loads. By distributing a larger current load among a greater number of contact arms, the amount of current carried by any one of the contact arms can essentially be maintained within a desired range.

By using latches integral to the housing members to secure terminal elements in the housing instead of separate members such as bolts and the like, the number of parts necessary for manufacturing the connector is reduced. Furthermore the elimination of securing means requiring apertures extending through the terminal elements provides an uninterrupted surface for carrying current across the interface. The structure of the present invention is, therefore, suitable for terminal elements having a relatively small array of contact arms such as shown in FIG. 6 as well as elements having larger arrays of contact arms.

Terminal elements 50,80 are preferably stamped and formed members made from a conductive material having the desired mechanical properties, and in particular low stress relaxation. Suitable materials include copper alloys, such as Olin C-151 available from Olin Brass, East Alton, Ill. C-151 has 85% to 95% of the conductivity of pure copper yet retains very good mechanical properties such as tensile strength and low relaxation under stress. The number of contact arms formed on each terminal element depends upon the width of the terminal body and the bar shaped member. The resistance at the interface is lowered and the normal force required per contact arm is lowered by using a plurality of contact arms. In the preferred method of making terminal elements, a plurality of contact arms are formed on opposing sides of a continuous strip of metal. Individual terminal elements having a desired number of contact arms are severed from the strip the center of the strip becoming the body of the terminal element with the notches and protrusions for positioning terminal elements being cut during the severing process.

A suitable insulting material for insulation means 78 includes flexible material such as MYLAR available from E. I. DuPont de Nemours and Company and other materials as known in the art. In the preferred embodiment dielectric housing member 14 is molded from a glass filled polyetherimide available from G. E. Plastics, Pittsfield, Mass. under the trade name ULTEM 2300. Other materials known in the art to be stable at high temperatures and non-hydroscopic are also suitable.

As can be seen from the Figures, the present invention provides an electrical connector having an assembly of terminal elements that can carry high currents of two different voltages across an interface. The present invention further allows the replacement of two single voltage bus bars by a dual voltage laminated bus bar. While the connector is shown mated to dual voltage bus bar members, it is to be understood that the blade-shaped members may be portions of circuit boards having conductors on opposed sides thereof as well as blade-shaped members having a single voltage. The present invention also is suitable for use with circuit boards and the like.

It is thought that the electrical connector of the present invention and many of its intended advantages will be understood from the foregoing description. Changes may be made in the form, construction and arrangement of parts thereof without departing from the spirit and scope of the invention or sacrificing all of its material advantages.

We claim:

1. An electrical connector for mating two blade-shaped members, each having opposed first and second sides, said connector comprising:

a pair of opposing first and second separate subassemblies, each subassembly comprising a housing member having major inner and outer surfaces, and at least a first terminal element secured to said inner surface of said housing member;

means detachably securing said subassemblies together, said subassemblies when secured together defining respective cavity means at opposite ends thereof for receiving first and second blade-shaped members;

each first terminal element including a body portion having first and second arrays of arms are one-piece with said body portion and extend outwardly from opposite ends thereof such that said arrays of arms extend inwardly from the respective inner housing surface toward the opposite subassembly and into respective cavity means when said subassemblies are secured together, thereby defining first and second receptacles including first and second opposed arrays of contact arms adapted to receive blade-shaped members and be deflected outwardly toward respective inner housing surfaces upon receiving said blade-shaped members; whereby upon mating said connector with first and second blade-shaped members and outward deflection against spring bias of all said arms by said blade-shaped members, said arrays of contact arms of said first terminal element of said first subassembly engage said first and second blade-shaped members at a plurality of locations along corresponding first sides thereof and said arms of said first terminal element of said second subassembly engage said first and second blade-shaped members at a plurality of locations along corresponding second sides thereof, thus allowing said blade-shaped members to be bipolar with said first and second sides thereof electrically isolated from each other.

2. The connector of claim 1 wherein said housing member of each subassembly includes deflectable latching means extending upwardly from a base portion of said inner housing surface, said latching means adapted to engage said terminal body portion to secure said at least one terminal element in said subassembly housing.

3. The connector of claim 1 wherein each said subassembly housing member includes a base, leading and trailing edges, and opposed upwardly extending sidewalls, said sidewalls including latching means extending toward said base and adapted to engage said body portion of said at least first terminal element in said subassembly.

4. The connector of claim 2 wherein each said subassembly further includes a second terminal element secured to said inner housing surface by said latching means.

5. The connector of claim 3 wherein each said subassembly further includes a second terminal element secured to said inner housing surface by said latching means.

6. The connector of claim 1 wherein each said subassembly further includes a second terminal element secured to said inner surface of said housing member, said second terminal element including a body portion having third and fourth arrays of contact arms extending outwardly from opposite ends thereof such that said arms define third and fourth opposed arrays of contact arms, said third opposed array being proximate and associated with said first opposed array and extending said first blade-receiving receptacle and said fourth opposed array is proximate and associated with said second opposed array and extending said second blade-receiving receptacle; whereby said second terminal elements provide further current paths interconnecting corresponding sides of said first and second blade-shaped members.

7. The connector of claim 6 wherein said housing member of each subassembly includes deflectable latching means extending upwardly from a base portion of said inner housing surface, said latching means adapted to engage said terminal body portion to secure said terminal elements in said subassembly housing.

8. The connector of claim 6 wherein said subassembly housing member includes a base, leading and trailing edges, and opposed upwardly extending sidewalls, said sidewalls including latching means extending toward said base and adapted to engage said body portion of said terminal elements in said subassembly.

9. The connector of claim 6 further including insulating means disposed between associated said first and second terminal elements, such that the current paths through the first terminal element are electrically isolated from the current paths through said second terminal element.

* * * * *